US005219821A

United States Patent [19]

Arbee et al.

[11] Patent Number: 5,219,821

[45] Date of Patent: Jun. 15, 1993

[54] NON-ACIDIC BARRIER COATING

[75] Inventors: Roberta R. Arbee, Nashua; Henry W. Goodwin, Milford, both of N.H.

[73] Assignee: Nashua Corporation, Nashua, N.H.

[21] Appl. No.: 657,633

[22] Filed: Feb. 19, 1991

[51] Int. Cl.[5] ..... B41M 5/40

[52] U.S. Cl. ..... 503/226; 427/152; 503/200

[58] Field of Search ..... 427/152; 503/200, 226

[56] References Cited

U.S. PATENT DOCUMENTS

| | | | |
|---|---|---|---|
| 4,370,370 | 1/1983 | Iwata et al. | 428/537 |
| 4,388,362 | 6/1983 | Iwata et al. | 428/211 |
| 4,507,669 | 3/1985 | Sakamoto et al. | 503/200 |
| 4,544,609 | 10/1985 | Hui | 428/507 |
| 4,591,887 | 5/1986 | Arbree et al. | 503/200 |
| 4,636,819 | 1/1987 | Nagamoto et al. | 503/200 |
| 4,663,642 | 5/1987 | Kameda et al. | 503/200 |
| 4,682,192 | 7/1987 | Nomura et al. | 503/200 |
| 4,695,606 | 9/1987 | Floyd et al. | 525/160 |
| 4,740,495 | 4/1988 | Marinelli et al. | 503/200 |
| 4,820,682 | 4/1989 | Shimomura et al. | 503/200 |
| 4,837,087 | 6/1989 | Floyd et al. | 428/511 |
| 4,885,271 | 12/1989 | Kawakami et al. | 503/200 |
| 4,898,849 | 2/1990 | Kang | 503/200 |
| 4,927,801 | 5/1990 | Mahmud | 503/200 |

FOREIGN PATENT DOCUMENTS

| | | | |
|---|---|---|---|
| 63-103244 | 4/1988 | Japan | 503/200 |

*Primary Examiner*—Pamela R. Schwartz

*Attorney, Agent, or Firm*—Testa, Hurwitz & Thibeault

[57] ABSTRACT

This invention relates to a heat-sensitive recording material. More particularly, this invention relates to a heat-sensitive recording material including a solvent-resistant and friction-reducing protective layer useful in the manufacture of adhesive-backed heat-sensitive labels and other thermally sensitive paper stock used in printers and facsimile equipment. The protective layer is non-acidic and has an improved resistance to background discoloration.

9 Claims, 1 Drawing Sheet

NON-ACIDIC BARRIER COATING

BACKGROUND OF THE INVENTION

This invention relates to a heat-sensitive recording material. More particularly, this invention relates to a heat-sensitive recording material having improved and substantially non-acidic, friction-reducing protective layer.

Adhesive-backed, heat-sensitive labels and other thermally sensitive paper stock are widely used in printers and facsimile equipment. Such labels are often placed on goods, including meats, produce or articles of manufacture which are commonly exposed to water, solvents or oleophilic materials during storage, transit or display. Typically, a bar code and/or alphanumeric information may be formed on such labels at the Point of sale by imaging the label with a thermal print head.

Known recording materials have a thermally imageable layer comprising a binder, a colorless or pale leuco dye, and an acidic substance that causes the dye to change color on the application of heat. Labels made from such materials are commonly used in grocery stores, delicatessens, and other points of sale where commodities are sold by weight. Increasingly, they are used on many other products. At or prior to a sale, the retailer weighs the product, commonly on a machine which integrates a scale, register, and thermal print head, and actuates the machine to deliver a thermally imprinted label indicating the price, weight, and other information in coded and/or alphanumeric form. The label is then affixed to the product, typically by means of a pressure-sensitive adhesive backing layer.

Labels of this type are often exposed to water, fats, oils, and other solvents which can have an adverse effect on the thermal image. For example, these solvents may increase background discoloration, or, in some cases, destroy the machine readability of the imprinted bar codes. The labels are often supplied in strips to facilitate rapid printing. As printing speed increases, the labels have been observed to jam the print head, requiring shutdown, cleanout, and restart.

Various protective coatings are disclosed in U.S. Pat. Nos. 4,370,370; 4,388,362; 4,591,887; 4,898,849 and 4,927,801. Typically, known protective coatings are cross-linked, and the mechanism of the cross-linking reaction requires an acidic environment and utilizes formaldehyde-containing crosslinking agents. One drawback of acidic protective coatings is that the acids used in forming the barrier layer can lead to background discoloration of the color producing layer. A disadvantage of known protective coatings is that certain materials contained therein, such as formaldehyde, can pose both environmental and health hazards. It would thus be desirable to replace these materials with non-acidic, organic materials which provide both pigmenting and friction-reducing properties. Further, it is advantageous to replace the previously used friction-improving pigments, e.g., the fluorocarbon and polyethylene pigments, as this eliminates the need for a dispersant which can cause "microfoam" and poor barrier coating uniformity. One difficulty with the previously known systems is in effecting the cross-linking of the protective coating despite the non-acidic environment of such a protective coating.

Accordingly, it is an object of this invention to develop a barrier layer for a heat-sensitive recording paper which protects the underlying image from damage by water and oleophilic materials. Another object is to produce a barrier layer having improved lubricity, thereby reducing friction between the print head and the thermal recording material. A further object is to produce a non-acidic barrier layer to prevent the background discoloration that can result from the use of an acidic barrier system. It is also an object to replace many of the potentially environmentally harmful components used in forming the barrier layer with more benign ones. Finally, it is an object of the invention to provide a non-acidic barrier layer containing an inorganic slip pigment to whiten the background while reducing friction with the print head. Other objects will be apparent to those skilled in the art upon reading the disclosure which follows.

SUMMARY OF THE INVENTION

The invention features a specialty paper or label stock which is a heat-sensitive recording material having at least three layers. The substrate underlies a heat-sensitive color-producing layer, and the heat-sensitive color-producing layer is itself coated with a substantially non-acidic, cross-linked, friction-reducing protective layer. An adhesive layer may be applied on the surface of the substrate opposite the color-producing layer. Preferably, the adhesive is a pressure-sensitive adhesive and is covered with an adhesive, releasable liner.

The color-producing layer may be a now conventional layer, such as disclosed in U.S. Pat. No. 4,591,887, which is incorporated herein by reference. It comprises a colorless or pale colored leuco dye, preferably in particulate form, an acidic developer substance to cause the dye to undergo color transformation upon imagewise application of heat to the recording material, a polymeric binder material, and an acid neutralizing (basic), preferably particulate, material for reducing background discoloration.

In one embodiment, the protective layer contains at least one covalently cross-linked resin catalyzed by a non-acidic or substantially non-acidic cross-linking agent, preferably a glyoxal derivative. The resin is preferably a polyvinyl alcohol. The polyvinyl alcohol may be a fully hydrolyzed, low viscosity polyvinyl alcohol, a superhydrolyzed, medium viscosity polyvinyl alcohol, or a mixture of the two. The protective layer also contains at least one inorganic, non-acidic filler material dispersed therein, and may contain a wetting agent. The filler is characterized by its ability to reduce surface friction and to prevent discoloration of the background. It is preferably aluminum trihydrate, precipitated silica, or, most preferably, calcium carbonate. The dry pH of this protective coating is non-acidic and is in the range of about 7.5 to 9.0.

In another embodiment, the protective layer also contains a chitinous compound, which is preferably a deacylated chitin, or chitosan. Such an embodiment offers the advantage of improved ink anchorage properties. The dry pH of this coating is substantially non-acidic and is in the range of about 6.5 to 8.0.

The protective layer of the present invention has a high solids content, preferably about 15% solids.

The recording material preferably may also have a second protective layer disposed on the side of the substrate opposite the imaging layer, that is, between the substrate and the adhesive layer, if an adhesive layer is employed.

The recording material of the invention is manufactured by the sequential application of two aqueous dispersions to the substrate, typically paper. The first dispersion, in addition to conventional color-producing components and binder, typically includes an acid-neutralizing agent to protect the dye from a premature reactive exposure resulting from the subsequent application of the acidic protective layer.

The second dispersion acts as a solvent resistant, friction reducing coating. In preferred embodiments, the protective coating is manufactured by blending a water-soluble organic resin, which can be covalently cross-linked in situ with an organic, non-acidic crosslinking agent. The organic resin is preferably a hydrolyzed, low to medium viscosity, polyvinyl alcohol. The preferred non-acidic crosslinking agent is a modified glyoxal. The preferred non-acidic or friction-reducing pigment material is an inorganic material such as aluminum trihydrate, precipitated silica, or, most preferably, calcium carbonate. Another embodiment of the friction-reducing dispersion includes a chitinous compound, preferably a deacylated chitin, or chitosan. In this second embodiment, the preferred pigments are aluminum trihydrate and precipitated silica. Application of the precoated substrate is accomplished through the use of a Meyer rod, or other conventional means known to those skilled in the art.

These and other features of the invention will be apparent from the description and claims which follow, from the non-limiting examples, and from the drawings.

DETAILED DESCRIPTION

Figure 1:
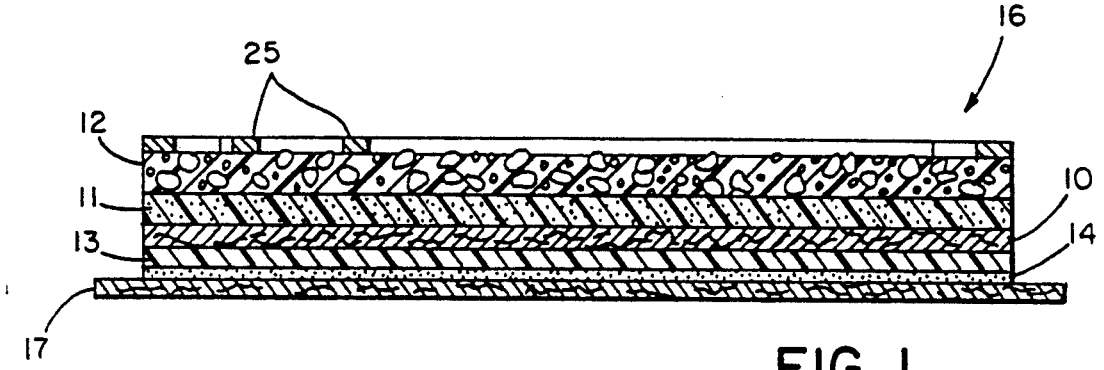
FIG. 1 is a schematic cross-sectional view of a recording label embodying the invention.
Figure 2:
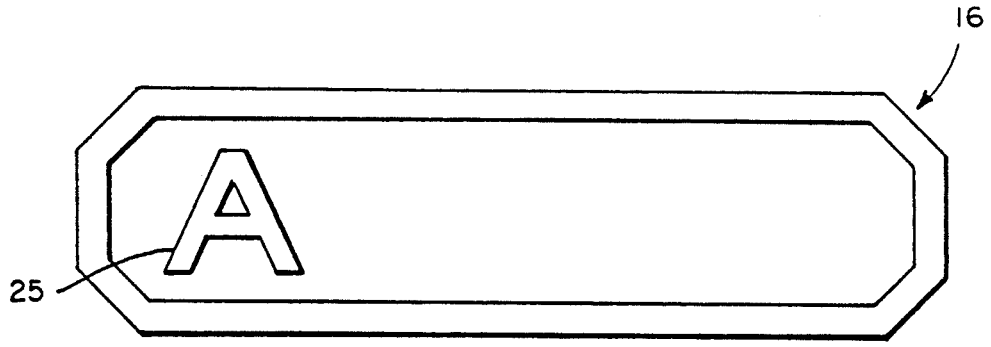
FIG. 2 is a plan view of the front side of the label of FIG. 1.

Referring to the drawings, FIGS. 1 and 2 schematically illustrate a label 16 embodying the invention. It comprises a typically medium weight cellulosic substrate 10. Adhered to the top side of the substrate is a heat-sensitive color-forming layer 11 that preferably has a coating weight of approximately 3 to 8 grams solids per square meter. Sandwiching layers 10 and 11 are a pair of protective layers 12 and 13. Layer 13 is covered by an adhesive layer 14 which in turn is protected until use by adhesive layer 17.

Layer 11 is a thermally sensitive, imagewise exposable layer which can vary widely in composition. It may comprise a composition known in the art such as disclosed in U.S. Pat. No. 4,591,887. It preferably comprises an intimate mixture of pale colored or colorless leuco dye, an acidic substance which functions to develop the dye, a polymeric binder material, and a particulate neutralizing agent.

The dye of layer 11 may be of the type generally known in the art which is activated by contact with a Proton donating (acidic) substance such as a metalized, e.g., zincated, organic acidic material. The preferred dyes are fluoran, lactone, phthalide, or triaryl methane dyes such as crystal violet lactone, 3-N-cyclohexyl, N-methyl-amino 6-methyl-7-anilino fluoran, or 3-pyrrolidino-6-methyl-7-anilino fluoran. Many other leuco dyes known to those skilled in the art may be used. The dye is typically present in particulate form, preferably as particles in the micron size range for adequate resolution as known by those skilled in the art.

The acidic developer substance comprises an organic acidic material, optionally treated with a metal such as zinc. Examples of materials which may be used include bisphenol A, phenolic condensation products, and various low melting point organic acids or their esters. The currently preferred developer material is para-benzyl hydroxybenzoate.

The polymeric binder of layer 11, for processing purposes, is preferably at least partly water-soluble. It Comprises one or a mixture of resinous materials which act to hold the other constituents of layer 11 together. The currently preferred binder material is polyvinyl alcohol. Other known binders which may be used include polyvinyl pyrrolidone, polyacrylamide, or modified cellulose.

The neutralizing agent contained in layer 11 may comprise a neutral colored, water-insoluble particulate material. In addition to the foregoing, layer 11 may also include inert fillers, lubricants, dispersants, and defoaming agents Present in minor amounts as processing aids.

Adhered to thermally sensitive color-forming layer 11 is a cross-linked protective layer 12 which is non-acidic or substantially non-acidic. The protective layer functions to maintain the contrast and readability of thermal images imprinted in layer 11 despite exposure to oils, fats, water, plasticizing materials and the like which may come in contact with the coated stock. It also functions as a lubricating layer to facilitate transport of the coated substrate over surfaces, and to minimize jamming when strips of labels (or other continuously-fed paper) are printed at high speed with a thermal head by imagewise thermal exposure of layer 11. Layer 12 is formed in situ from a previously prepared aqueous coating composition.

The coating composition used to form the protective layer comprises at least one resin which is cross-linked in situ at or above room temperature, provided the temperature is not sufficient to develop prematurely the leuco dye. The resistance to solvents, such as oils and plasticizers, of the protective layer of the present invention is believed to be attributable to the in situ crosslinking of the layer. This protective layer also achieves excellent lubricity while using a non-acidic, formaldehyde-free crosslinking system. The components of the present protective layer which contribute to reduced friction are inorganic filler materials. These filler materials additionally contribute to an improved ability to withstand background discoloration as they are non-acidic.

The resin material used in the protective layer of the present invention typically is a polyvinyl alcohol. The polyvinyl alcohols which can be used to form the protective layer can be of low to medium viscosity. A preferred resin component used in the protective layer of this invention is a mixture of a fully hydrolyzed, low viscosity polyvinyl alcohol (e.g., Airvol 103, Air Products and Chemicals, Inc., Allentown, PA) and a superhydrolyzed, medium viscosity polyvinyl alcohol (e.g., Airvol 125, Air Products and Chemicals, Inc., Allentown, PA). The ratio of low viscosity polyvinyl alcohol to medium viscosity polyvinyl alcohol is preferably in the range of 1:1 to 3:2.

The term "low viscosity" is used to identify viscosities ranging from 2 to 4 cps (4% aqueous soln. at 20° C.). The term "medium viscosity" is used to identify viscosities ranging from 26 to 30 cps (4% aqueous soln. at 20° C.).

The inorganic filler materials which may be used in the protective layer to decrease surface friction serve as pigments and provide resistance to background discoloration. They preferably are non-acidic materials. These materials preferably include calcium carbonate, aluminum trihydrate or precipitated silica and mixtures of these materials. The total of the filler component present in the protective layer ranges from about 5 to about 30% by weight.

Exemplary calcium carbonate fillers include Albagloss (Pfizer, New York, NY) and Hydrocarb 90 (OMYA, Inc., Proctor, VT). Aluminum trihydrate materials which may be used in the protective layer include Hydral 710, which is commercially available from ALCOA, Pittsburgh, PA. Suitable precipitated silica materials include Sansil WB-42, available from PPG Industries, Inc., Appleton, WI.

In Protective layers known in the art, cross-linking is generally accomplished through the use of an acidic cross-linking agent. However, the use of such an acidic cross-linking agent is not practical in the formation of the present protective layer because the system is non-acidic or substantially non-acidic. Instead, a non-acidic cross-linking agent must be utilized. A preferred non-acidic cross-linking agent which may be used in the formation of the protective layer of the present invention is a modified glyoxal compound. Such modified glyoxal compounds are represented by the general formula:

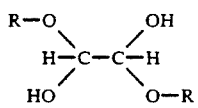

where R represents lower alkyl groups. The molecular weight of such materials is typically below 500. Preferred modified glyoxal compounds are modified polyhydroxy alkyl ether acetal compounds available from PPG Industries, Inc. of Appleton, Wisconsin, under the trade name CURESAN TM. Preferred CURESAN TM compounds include CURESAN TM 199, 200 and 300. Currently the most preferred commercially available cross-linking agent is CURESAN TM 200. The non-acidic cross-linking agent is preferably used in an amount ranging from about 0.5 to 12% by weight.

In applications where label stock will be printed upon, and additional ink anchorage is required, it is desirable to include a chitinous material, such as chitosan, within the protective layer. Chitosan is an amino poly saccharide having an average MW ~ 100,000, specifically, β-1,4-linked 2-amino-2-deoxy-D-glucose units prepared by hydrolysis of the N-acetyl groups of chitin. Chitosan preferably is used in an aqueous solution in an amount ranging from about 40 to 60% by weight.

In the first embodiment, the protective layer preferably contains the following ingredients in the following relative parts by weight:

| Ingredient | Parts by Weight |
|---|---|
| Fully hydrolyzed, low viscosity polyvinyl alcohol | 80–120 |
| Superhydrolyzed, medium viscosity polyvinyl alcohol | 60–120 |
| Modified glyoxal cross-linking agent | 4–12 |
| Inorganic, non-acidic filler material | 10–30 |
| Wetting agent | 1–2 |

-continued

| Ingredient | Parts by Weight |
|---|---|
| Water | 20–30 |

The protective layer of this formulation has a surface pH ranging from about 7.5 to about 9.0.

In another embodiment, the protective layer preferably contains the following ingredients in the following relative parts by weight:

| Ingredient | Parts by Weight |
|---|---|
| Fully hydrolyzed, low viscosity polyvinyl alcohol | 110–160 |
| Superhydrolyzed, medium viscosity polyvinyl alcohol | 0–65 |
| Chitinous solution | 40–60 |
| Modified glyoxal cross-linking agent | 0.5–2.5 |
| Inorganic, non-acidic filler material | 5–20 |
| Water | 15–40 |

The protective layer of this formulation has a surface pH ranging from about 6.5 to about 8.0

It has been found that cross-linking of the coating is optimized at room temperature (70° F.) when the dry pH of the resin mixture is within the range of approximately 7.5 to 9.0, or 6.5 to 8.0 when chitosan is added. At pH levels outside this range, the covalent cross-linking reaction slows and eventually ceases.

Label 16 also preferably includes a water-insoluble lower protective layer 13, coated on substrate 10, on the side opposite the color-forming layer 11. Layer 13 protects the color-forming layer 11 from contaminants such as oils, water, and plasticizers that may seep through the package to which label 16 is adhered. The lower protective layer 13 may be similar or identical in composition to the protective layer 12, i.e., may comprise a water-insoluble cross-linked resin with or without a chitinous material.

A pressure-sensitive or other type of adhesive layer 14 may be deposited on protective layer 13. Adhesive layer 14 is deposited in a conventional manner, and backed by an adhesive releasable liner 17. Adhesive liner 17 may comprise paper coated with silicone or other suitable adhesive material. The label may be printed with a suitable ink with a bar code or alphanumeric character illustrated at 25.

The invention will be further understood from the following non-limiting examples wherein all parts are by weight.

EXAMPLES

The approach to production of the improved thermally sensitive labels, sheets, etc. embodying the invention is to apply the protective layer directly over a previously applied thermally sensitive layer. The thermal layer is produced from a first dispersion containing the leuco dye and other ingredients set forth below, and a second dispersion comprising the acidic developer material and particulate neutralizing agent, which are then mixed, and the product is applied to a substrate.

Examples of dispersion 1 (Mix A) and dispersion 2 (Mix B) are set forth below.

| Color Forming Layer | Part |
|---|---|
| Mix Dispersion A | |
| Polyvinyl alcohol (approx. 10% solution) | 110 parts |
| 3-N-cyclohexyl, N-methyl amino-6-methyl-7-anilino fluoran | 50 parts |
| Defoamer | 0.1 parts |
| Water | 140 parts |
| Mix Dispersion A' | |
| Polyvinyl alcohol (approx. 10% solution) | 100 parts |
| Crystal Violet Lactone | 60 parts |
| Defoamer | 0.1 parts |
| Water | 160 parts |
| Mix Dispersion A" | |
| Carboxy methyl cellulose (approx. 10% solution) | 110 parts |
| 3 Pyrrolidino-6 methyl-7 anilino fluoran | 55 parts |
| Defoamer | 0.1 parts |
| Water | 145 parts |
| Mix Dispersion B | |
| Polyvinyl alcohol (approx. 10% solution) | 100 parts |
| Water | 140 parts |
| Dispersing agent | 2 parts |
| Zinc stearate | 10 parts |
| Aluminum trihydrate | 27.5 parts |
| p-Benzyl hydroxybenzoate | 20 parts |
| Calcium carbonate | 2.5 parts |
| Mix Dispersion B' | |
| Polyvinyl alcohol (approx. 10% solution) | 100 parts |
| Water | 140 parts |
| Dispersing agent | 2 parts |
| Stearamide (steric acid amide) | 10 parts |
| Talc | 28 parts |
| Bis-phenol A | 20 parts |
| Calcium carbonate (particulate) | 3 parts |

Mix A, A' and A" may be prepared by first dispersing the ingredients in the water using a Baranco mixer for 15 minutes, and then reducing the particle size by way of attrition for 60 minutes. The B or B' mix may be prepared by dispersing the ingredients using a mixer for 15 minutes after all of the dry components are added together. The ingredients are added to the mix tank in the order shown above. The particle size is reduced by attriting for 30 minutes. Any one of the "A" mix dispersions may be combined with either of the "B" mix dispersions at a ratio of 5 to 15 parts A per 50 parts B. The blend is then coated onto paper, e.g., 39 pound (24×36) and dried to produce a dry coating weight of approximately to grams per square meter.

BARRIER COATING I

Example I

In one embodiment, the protective layer is prepared by combining 80 parts of a 12% solution of a fully hydrolyzed, low viscosity grade polyvinyl alcohol (e.g., Airvol 103, Air Products) and 120 parts of an 8% solution of a superhydrolyzed, medium viscosity grade polyvinyl alcohol (e.g., Airvol 125, Air Products), with 12 parts of a 50% solution of a non-acidic cross-linking agent (e.g., Curesan TM 200, PPG), 10 parts of a 50% slurry of calcium carbonate, 1 part of a 1% solution of a wetting agent (e.g., Triton X-100, Rohm & Haas), and 40 parts water. This mixture is dispersed in a high shear mixer for a period of 5 to 15 minutes. The composition is then applied to a substrate with a Meyer rod to a dry coating weight of 3.5 to 5.0 grams per square meter.

The protective layer prepared and applied as disclosed above is tested for its resistance to oil, plasticizers, and water and for its improved ability to prevent background discoloration, its Instron friction, and Minolta values. The test protocols are set forth below, and the test results appear in Table I.

TESTING PROTOCOLS

A. Plasticizer Resistance

The imaged sample is wrapped in three complete wraps of PVC film (e.g., Borden Resinite RMF-61). The wrapped samples are placed in a 100° F. (38° C.) oven for 16 hours under 2.5 psi (0.176 kg/cm$^2$) pressure. After unwrapping the sample, the image density is measured using a MacBeth 914 Densitometer and reported as "Plasticizer Resistance."

B. Oil Resistance

Cottonseed oil is spread over the imaged label surface. The label is then placed in a 100° F. (38° C.) oven for 16 hours. Any remaining oil is removed with hexane, and the sample is dried. The image density is then measured using a MacBeth 914 Densitometer and reported as "Oil Resistance."

C. Water Resistance

The imaged labels are soaked in water at room temperature for 16 hours. The sample is removed from the water and dried. The image density is then measured using a MacBeth 914 Densitometer and reported as "Water Resistance."

D. Heat Stability

Unimaged samples are placed in a 150° F. (65.5° C.) oven for 1 hour. The background is measured after the test using a MacBeth 914 Densitometer and reported as "Heat Stability."

E. Instron Friction

A Hobart 18VP thermal printer printing mechanism is mounted in a Instron tester. A 2½"×15" strip of paper is then pulled through this mechanism at a speed of 20" per minute. The pull force is reported as the "Instron Friction" value.

F. Minolta Values

The Minolta CR-200 is used to measure three values which together provide a measurement of the brightness and shade of the coated paper:

1. L" Value—a measure of brightness: the higher the value, the brighter the sheet.
2. "a" Value—a measure of the red/green shade: the more positive the value, the redder the shade; the more negative the value, the greener the shade.
3. "b" Value—a measure of the blue/yellow shade: the more positive the value, the yellower the shade; the more negative the value, the bluer the shade.

EXAMPLE II

Following the procedure of Example I, a protective coating is prepared according to the following formulation:

| Material | Parts by Weight |
|---|---|
| 12% solution of Airvol 103 (Air Products) | 80 |
| 8% solution of Airvol 125 (Air Products) | 120 |
| 50% solution of Curesan TM 200 (PPG) | 4 |
| 50% slurry of Calcium Carbonate | 15 |
| 1% solution of Triton X-100 (Rohm & Haas) | 1 |

-continued

| Material | Parts by Weight |
|---|---|
| Water | 40 |

This mixture is dispersed in a high shear mixer for 5 to 15 minutes. This dispersion is applied to the coated substrate with a Meyer rod at a dry coating weight of 3.5 to 5.0 gsm. The coating is tested according to the protocols of Example I, and the results are set forth in Table I.

Example III

Following the procedure of Example I, a protective coating is prepared according to the following formation:

| Material | Parts by Weight |
|---|---|
| 12% solution of Airvol 103 (Air Products) | 110 |
| 8% solution of Airvol 125 (Air Products) | 75 |
| 50% solution of Curesan TM 200 (PPG) | 8 |
| 50% slurry of Aluminum Trihydrate | 30 |
| 1% solution of Triton X-100 (Rohm & Haas) | 2 |
| Water | 25 |

This mixture is dispersed in a high shear mixer for 5 to 15 minutes. This dispersion is applied to the coated substrate with a Meyer rod at a dry coating weight of 3.5 to 5.0 gsm. The coating is tested according to the protocols of Example I, and the results are set forth in Table I.

BARRIER COATING II

Example IV

An alternative protective layer, having improved ink anchorage, is prepared by combining 150 parts of a 12% solution of a fully hydrolyzed, low viscosity grade polyvinyl alcohol (e.g., Airvol 103, Air Products) and 11.5 parts of a 13% solution of a superhydrolyzed, medium viscosity grade polyvinyl alcohol (e.g., Airvol 125, Air Products), with 45 parts Solution A (22 parts chitosan (solid) and 17 parts of 86% lactic acid in 262 parts water), 0.6 parts of a 50% solution of Curesan TM 200 (PPG), 10.5 parts of a 46% slurry of SanSil WB-42 (PPG) and 32.0 parts water. The mixture is dispersed in a high shear mixer for 5 to 15 minutes. The composition is then applied to a substrate with a Meyer rod to dry coating weight of 3.5 to 5.0 gsm.

The protective layer prepared and applied as described above is tested according to the protocols of Example I, and the results are set forth in Table I.

Example V

Following the procedure of Example IV, a protective layer is prepared according to the following formulation:

| Material | Parts by Weight |
|---|---|
| 12% solution of Airvol 103 (Air Products) | 148 |
| Solution A | 52 |
| 50% solution of Curesan TM 200 (PPG) | 2.1 |
| SanSil WB-42 (PPG) (46% slurry) | 15 |
| Water | 16 |

This mixture is dispersed in a high shear mixer for 5 to 15 minutes. This dispersion is applied to the coated substrate with a Meyer rod at a dry coating weight of 3.5 to 5.0 gsm. The coating is tested according to the protocols of Example I, and the results are set forth in Table I.

Example VI

Following the procedure of Example IV, a protective coating is prepared according to the following formulation:

| Material | Parts by Weight |
|---|---|
| 12% solution of Airvol 103 (Air Products) | 112 |
| 13% solution of Airvol 125 (Air Products) | 62 |
| Solution A | 45 |
| 50% solution of Curesan TM 200 (PPG) | 1.2 |
| SanSil WB-42 (PPG) (46% slurry) | 6.5 |
| Water | 22 |

This mixture is dispersed in a high shear mixer for 5 to 15 minutes. This dispersion is applied to the coated substrate with a Meyer rod at a dry coating weight of 3.5 to 5.0 gsm. The coating is tested according to the protocols of Example I, and the results are set forth in Table I.

TABLE I

| | THERMAL LABEL MODIFIED BARRIER TEST RESULTS | | | | | | |
|---|---|---|---|---|---|---|---|
| PROPERTY | I | II | II | IV | V | VI | STANDARD BARRIER |
| Plasticizer Resistance | 0.68 | 0.93 | 0.80 | 1.16 | 1.22 | 1.29 | 0.92 |
| Oil Resistance | 0.65 | 0.65 | 0.71 | 0.78 | 0.98 | 0.86 | 0.75 |
| Water Resistance | 1.12 | 1.11 | 1.14 | 1.10 | 1.11 | 1.13 | 1.13 |
| Instron Friction (lbs.) | 0.80 | 0.82 | 0.94 | 0.80 | 0.81 | 0.81 | 0.83 |
| Mix - % Solids | 11.5 | 11.0 | 15.3 | 12.0 | 13.7 | 12.2 | 9.5 |
| Mix - Viscosity (cps) | | | | | | | |
| Initial | 136 | 120 | 100 | 100 | 118 | 295 | 193 |
| 1 day | 143 | 125 | 105 | 106 | 122 | 318 | 203 |
| 7 days | 143 | 130 | 102 | 103 | 124 | 312 | 191 |
| Mix - pH | 8.0 | 8.3 | 7.6 | 4.2 | 4.1 | 4.3 | 3.0 |
| Minolta Values | | | | | | | |
| "L" | 91.57 | 91.28 | 90.01 | 91.14 | 90.74 | 91.58 | 90.88 |
| "a" | 0.33 | 0.32 | 0.39 | 0.24 | 0.12 | 0.32 | 0.26 |
| "b" | 1.80 | 2.21 | 1.88 | 2.58 | 3.12 | 2.27 | 1.81 |

What is claimed is:

1. A heat-sensitive recording material comprising:

(a) a substrate;

(b) a thermal imagewise imprintable color-producing layer affixed to a first surface of said substrate comprising an acidic developer, a leuco dye developable upon exposure to said acidic developer, and a binder material for said dye and developer; and (c) a non-acidic friction-reducing protective layer comprising an organic, water-soluble resin, cross-linked during its formation in situ atop said color-producing layer by a non-acidic cross-linking agent, and an inorganic, non-acidic filler material characterized by its ability to reduce surface friction;

wherein said protective layer has a dry surface pH of from about 7.5 to about 9.0.

2. The material of claim 1 wherein said non-acidic cross-linking agent comprises a modified glyoxal compound having the formula:

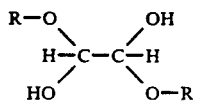

where R represents lower alkyl groups.

3. The recording material of claim 1 further comprising an adhesive layer affixed to a second surface of said substrate opposite said first surface.

4. The material of claim 1, wherein said friction-reducing protective layer further comprises a chitinous compound, and wherein said protective layer has a dry surface pH of from about 7.5 to about 8.0.

5. The material of claim 4 wherein said chitinous compound is chitosan.

6. The material of claim 4 wherein said protective layer is formed in situ from a coating dispersion comprising the following ingredients in the following relative parts by weight:

| Ingredient | Parts by Weight |
|---|---|
| Fully hydrolyzed, low viscosity polyvinyl alcohol | 110–160 |
| Superhydrolyzed, medium viscosity polyvinyl alcohol | 0–65 |
| Aqueous chitinous solution | 40–60 |
| 0.08% chitinous compound | 0.5–2.5 |
| Modified glyoxal cross-linking agent | |
| Inorganic, non-acidic filler material | 5–20 |
| Water | 15–40. |

7. The material of claim 1 wherein said organic water-soluble resin is selected from the group consisting of a fully hydrolyzed, low viscosity polyvinyl alcohol, a superhydrolyzed, medium viscosity polyvinyl alcohol, and mixtures thereof.

8. The material of claim 1 wherein said inorganic, filler material is selected from the group consisting of calcium carbonate, aluminum trihydrate, precipitated silica, and mixtures thereof.

9. The material of claim 1 wherein said protective layer is formed in situ from a coating dispersion comprising the following ingredients in the following relative parts by weight:

| Ingredient | Parts by Weight |
|---|---|
| Fully hydrolyzed, low viscosity polyvinyl alcohol | 80–120 |
| Superhydrolyzed, medium viscosity polyvinyl alcohol | 60–120 |
| Modified glyoxal cross-linking agent | 4–12 |
| Inorganic, non-acidic filler material | 10–30 |
| Wetting agent | 1–2 |
| Water | 20–30. |

* * * * *